US009074371B2

(12) United States Patent
Russell

(10) Patent No.: US 9,074,371 B2
(45) **Date of Patent: *Jul. 7, 2015**

(54) LOAD BEARING STRUCTURAL ASSEMBLY

(71) Applicant: Bradford O. Russell, Garland, TX (US)

(72) Inventor: Bradford O. Russell, Garland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/450,425

(22) Filed: Aug. 4, 2014

(65) Prior Publication Data

US 2014/0338281 A1 Nov. 20, 2014

Related U.S. Application Data

(63) Continuation of application No. 13/969,529, filed on Aug. 17, 2013, now Pat. No. 8,793,961.

(60) Provisional application No. 61/691,555, filed on Aug. 21, 2012.

(51) Int. Cl.

| | |
|---|---|
| ***E04C 2/42*** | (2006.01) |
| ***E04C 5/04*** | (2006.01) |
| ***E04F 15/06*** | (2006.01) |
| ***E04F 19/10*** | (2006.01) |
| ***E04C 3/08*** | (2006.01) |

(52) U.S. Cl.

CPC ... *E04C 2/42* (2013.01); *E04C 3/08* (2013.01); *E04C 2/428* (2013.01)

(58) Field of Classification Search

CPC ..... E04C 2003/0486; E04C 2003/0495; E04C 3/38; E04C 3/40; E04C 3/42; E04C 3/44; E04C 3/46; E04C 3/00; E04C 2/42; E04C 2/428; E04C 3/08; E04B 2001/1927; E04H 12/10

USPC ..... 52/660, 663

See application file for complete search history.

(56) References Cited

U.S. PATENT DOCUMENTS

| | | | |
|---|---|---|---|
| 2,756,032 | A | 7/1956 | Dowell |
| 3,379,221 | A | 4/1968 | Harry et al. |
| 4,432,485 | A | 2/1984 | Smith |
| 5,423,353 | A | 6/1995 | Sorensen |
| 5,433,252 | A | 7/1995 | Wolf et al. |
| 5,580,622 | A | 12/1996 | Lockshaw et al. |
| 5,996,643 | A | 12/1999 | Stonitsch |
| 6,311,514 | B1 | 11/2001 | Chisnell |
| 6,405,974 | B1 | 6/2002 | Herrington |
| 6,893,733 | B2 | 5/2005 | Obeshaw |
| 6,955,780 | B2 | 10/2005 | Herrington |
| 7,000,644 | B2 | 2/2006 | Ichimura et al. |

(Continued)

FOREIGN PATENT DOCUMENTS

| | | |
|---|---|---|
| CN | 1405415 | 3/2003 |
| EP | 0959524 | 11/1999 |
| JP | 2005314986 | 11/2005 |

OTHER PUBLICATIONS

International Search Report and Written Opinion; PCT Application No. PCT/US2013/055483; Dec. 10, 2013.

*Primary Examiner* — Mark Wendell

(74) *Attorney, Agent, or Firm* — James L. Baudino

(57) ABSTRACT

According to one aspect of the present disclosure, a load bearing structural assembly includes an outer loop member; an inner loop member spaced apart from and sized smaller than the outer loop member; and a web assembly coupled to and extending between the outer loop member and the inner loop member, the web assembly comprising a plurality of arcuately formed web members.

14 Claims, 12 Drawing Sheets

(56) References Cited

U.S. PATENT DOCUMENTS

| | | | |
|---|---|---|---|
| 7,025,580 | B2 | 4/2006 | Heagy et al. |
| 8,104,524 | B2 | 1/2012 | Manesh et al. |
| 8,109,308 | B2 | 2/2012 | Manesh et al. |
| 8,176,957 | B2 | 5/2012 | Manesh et al. |
| 2002/0006523 | A1 | 1/2002 | Obeshaw |
| 2002/0125607 | A1 | 9/2002 | Herrington |
| 2005/0138885 | A1 | 6/2005 | Rotherroe |
| 2007/0034274 | A1 | 2/2007 | Herrington |
| 2009/0133355 | A1 | 5/2009 | Mobrem |
| 2010/0200192 | A1 | 8/2010 | Consigny |
| 2011/0079335 | A1 | 4/2011 | Manesh et al. |
| 2012/0031616 | A1 | 2/2012 | Hall |
| 2012/0234445 | A1 | 9/2012 | Manesh et al. |
| 2012/0241062 | A1 | 9/2012 | Manesh et al. |

LOAD BEARING STRUCTURAL ASSEMBLY

BACKGROUND

Many types of structures use a post and beam design for distributing and/or resolving horizontal and vertical forces. For example, post and beam designs generally utilize vertical or upright posts and horizontal beams joined to the posts. Loads are transferred through the horizontal beams to the vertical posts secured on a suitable base or foundation.

BRIEF SUMMARY

According to one aspect of the present disclosure, a load bearing structural assembly is disclosed. The load bearing structural assembly includes an outer loop member; an inner loop member spaced apart from and sized smaller than the outer loop member; and a web assembly coupled to and extending between the outer loop member and the inner loop member, the web assembly comprising a plurality of arcuately formed web members.

According to another aspect of the present disclosure, a load bearing structural assembly includes a first loop member; a second loop member spaced apart from and concentric with the first loop member; a first set of arcuate members extending between the first and second loop members, each of the first set of arcuate members having ends thereof coupled to the first loop member; and a second set of arcuate members extending between the first and second loop members, each of the second set of arcuate members having a first end thereof coupled to the first loop member and a second end thereof coupled to the second loop member.

According to another aspect of the present disclosure, a load bearing structural assembly includes a plurality of first loop members coupled together; a plurality second loop members, each of the second loop members sized smaller than and located within a respective first loop member; and a web assembly coupled to and extending between each respective first and second loop members, each web assembly comprising a plurality of arcuately formed web members.

BRIEF DESCRIPTION OF THE SEVERAL VIEWS OF THE DRAWINGS

For a more complete understanding of the present application, the objects and advantages thereof, reference is now made to the following descriptions taken in conjunction with the accompanying drawings, in which.

DETAILED DESCRIPTION

Embodiments of the present disclosure provide a load bearing structural assembly having an array of arcuate members arranged in a configuration to resist forces in bending. The members are arranged to distribute forces more evenly to the overall force resisting structural assembly. The assembly of members is arranged between an outer member and an inner member so as to distribute the load more equally through the load bearing structural members and to the force resisting structural assembly. A web of arcuate members is located between the inner and outer members and is configured having a spacing, quantity and/or size to accommodate force resisting and deflection requirements. According to one embodiment, a load bearing structural assembly includes an outer loop member, an inner loop member spaced apart from and sized smaller than the outer loop member, and a web assembly coupled to and extending between the outer loop member and the inner loop member, where the web assembly comprises a plurality of arcuately formed web members.

Figure 1:
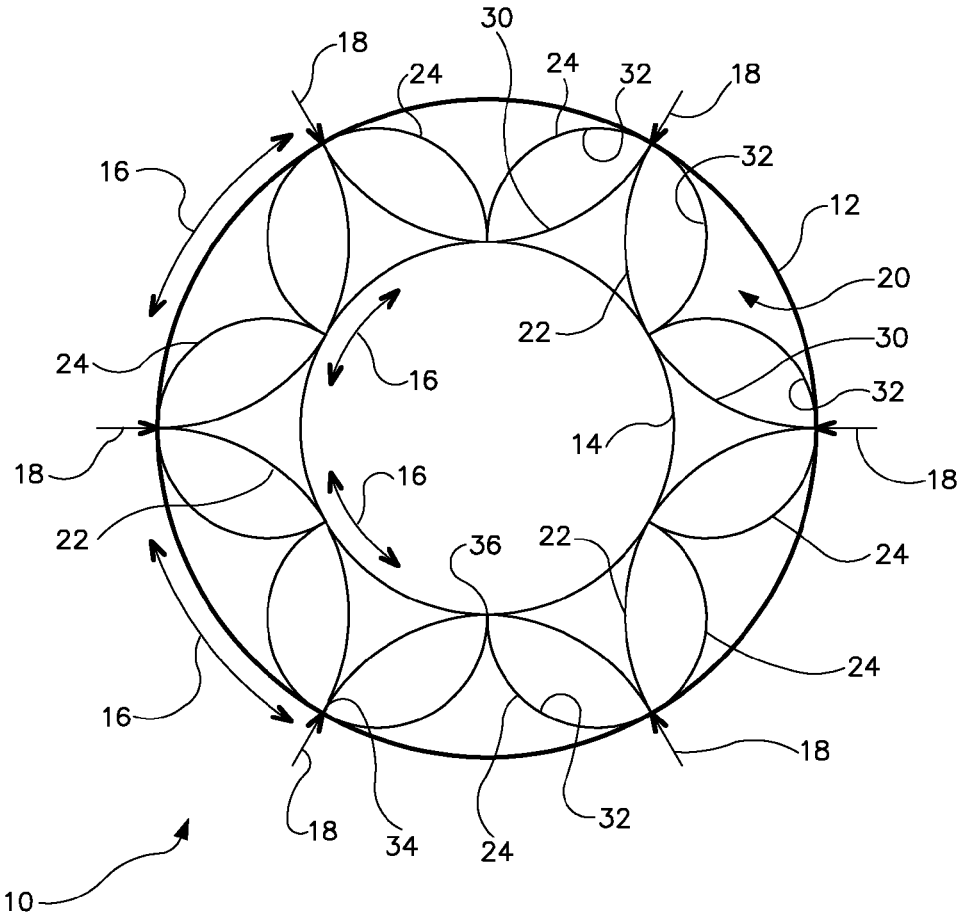
FIG. 1 is a diagram illustrating an embodiment of a load bearing structural assembly according to the present disclosure.
Figure 2:
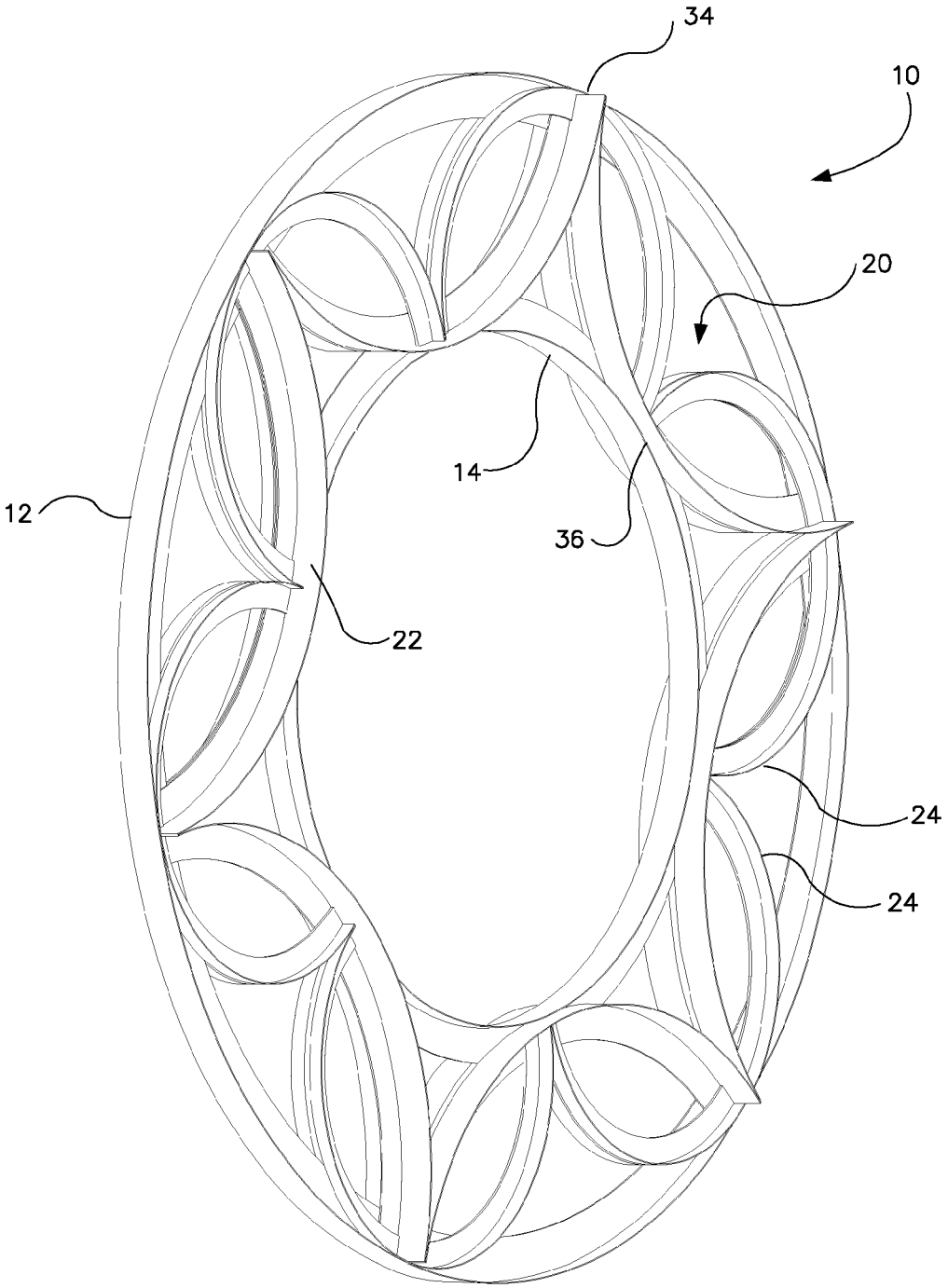
FIG. 2 is a diagram illustrating an isometric view of an embodiment of the load bearing structural assembly of FIG. 1 according to the present disclosure.

With reference now to the Figures and in particular with reference to FIGS. 1 and 2, exemplary diagrams of a load bearing structural assembly 10 according to the present disclosure are provided. FIG. 1 is a diagram illustrating an embodiment of assembly 10 according to the present disclosure, and FIG. 2 is a diagram illustrating an isometric view of assembly 10 illustrated in FIG. 1. In FIGS. 1 and 2, assembly 10 is depicted as a substantially planar arrangement of structural elements and comprises an outer loop member 12 and an inner loop member 14. In FIGS. 1 and 2, outer loop member 12 and inner loop member 14 are generally circular in shape and located concentric relative to each other such that outer loop member 12 is larger than and located spaced apart from a smaller inner loop member 14 by a desired distance (e.g., to efficiently distribute load in the directions of 16 and 18). It should also be understood that in some embodiments, loop member 12 and/or loop member 14 may be slightly non-circular (e.g., slightly elliptical) and may be located non-concentric relative to each other. In the illustrated embodiment, a shear web assembly 20 is located between and connects outer loop member 12 and inner loop member 14. In the illustrated embodiment, shear web assembly 20 comprises a plurality of web members 22 and a plurality of web members 24. Web members 22 are arcuately formed having a concave face 30 facing outwardly toward outer loop member 12. Web members 24 are arcuately formed having a concave face 32 facing inwardly toward inner loop member 14. In some embodiments, web members 22 and 24 are configured as circular and/or partially circular members (e.g., having a constant and/or fixed radius of curvature); however, it should be understood that web members 22 and/or 24 may be slightly non-circular (e.g., elliptical). In the illustrated embodiment, six web members 22 and twelve web members 24 are illustrated. However, the quantity and/or sizing of web members 22 and 24 may vary (e.g., to accommodate load and deflection requirements). Additionally, in the illustrated embodiment, a radius of curvature of web members 24 is less than a radius of curvature of web members 22.

In the illustrated embodiment, each end of a particular web member 22 is coupled to outer loop member 12 (e.g., at location 34), and web members 22 are sized having a length such that ends of adjacent web members 22 terminate at (or near) a common/coincident location relative to outer loop member 12 (e.g., at location 34). A medial location 36 of each web member 22 is coupled to inner loop member 14. In the illustrated embodiment, web members 22 are formed as a continuous element having each end thereof coupled to outer loop member 12 and a medial location thereof coupled to inner loop member 14; however, it should be understood that in some embodiments, web member 22 may be formed from multiple components/elements along its length (e.g., a first element extending from outer loop member 12 to inner loop member 14, and another element extending from inner loop member 14 to outer loop member 12).

Web members 24 are each sized such that one end thereof terminates and is connected to medial location 36 of web member 22 while an opposite end thereof terminates and is connected to outer loop 12 at location 34. Thus, as illustrated in FIG. 1, ends of adjacent web members 24 terminate at (or near) a common/coincident location (e.g., with ends of adjacent web members 22 at a particular location 34).

Figure 3:
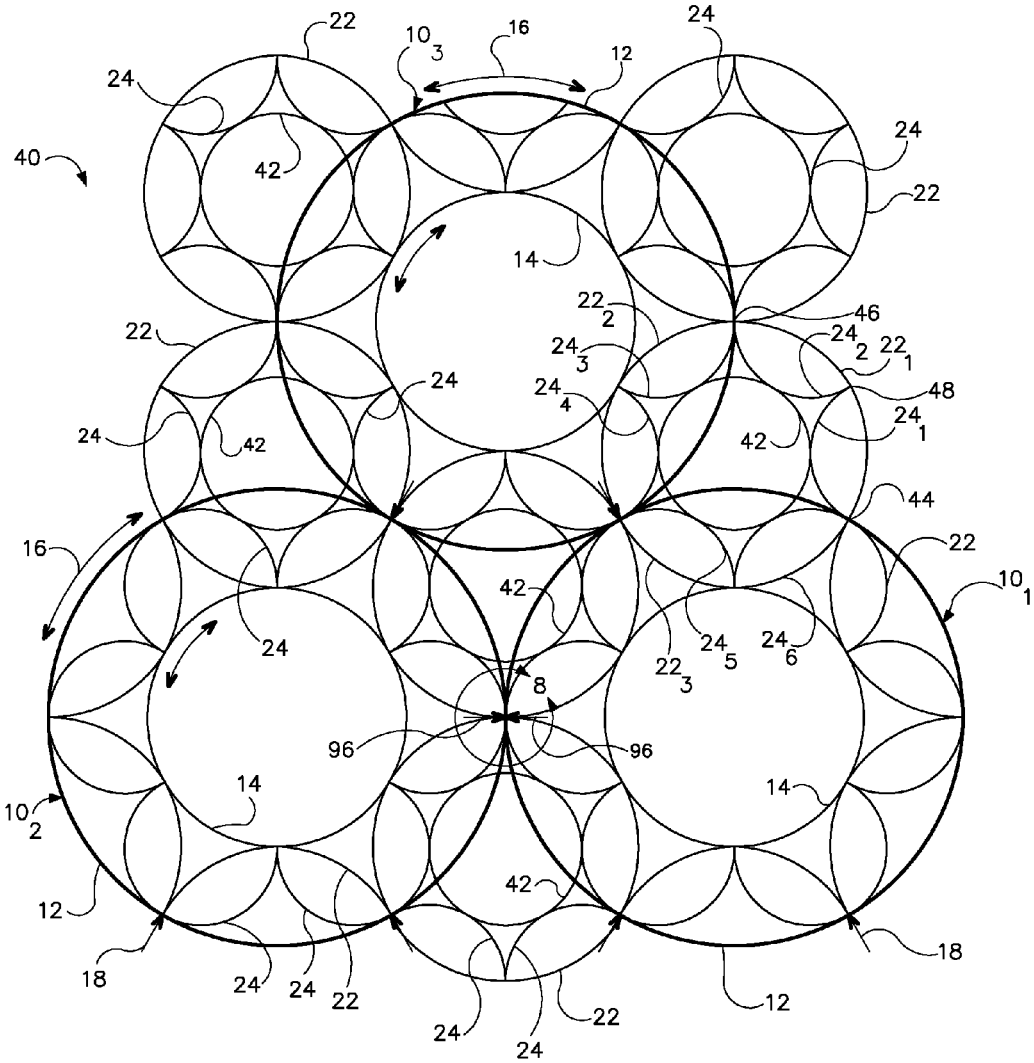
FIG. 3 is a diagram illustrating another embodiment of a load bearing structural assembly according to the present disclosure.

FIG. 3 is a diagram illustrating an embodiment of a load bearing structural assembly 40 including multiple assemblies 10 according to the present disclosure. In the embodiment illustrated in FIG. 3, assembly 40 includes three assemblies 10 (e.g., assembly $\mathbf{10}_1$, $\mathbf{10}_2$ and $\mathbf{10}_3$) coupled together at (or near) tangential locations along adjacent outer loop members 12 of respective assemblies 10. As illustrated in FIG. 3, each assembly 10 includes outer loop member 12, inner loop member 14 and web members 22 and 24 (e.g., as depicted in FIGS. 1 and 2). Assembly 40 also includes loop members 42 and additional web members 22 and 24 that may be coupled at various locations relative to assemblies 10 to form an array of structural elements. For example, in the illustrated embodiment, additional web members 22 (e.g., web member $\mathbf{22}_1$) may be positioned to extend from an outer location of one loop member 12 (e.g., location 44) to an outer location of another loop member 12 (e.g., location 46) at various locations of assembly 40. Further, web members 24 (e.g., web members $\mathbf{24}_1$ and $\mathbf{24}_2$) may be located relative to such web members 22 (e.g., web member $\mathbf{22}_1$) such that web members 24 extend from location 44 to location 46. For example, web member $\mathbf{24}_1$ extends from location 44 to a medial location 48 of web member $\mathbf{22}_1$, and web member $\mathbf{24}_2$ extends from medial location 48 to location 46. This arrangement of web members 22 and 24 may be located at various positions of assembly 40.

Additionally, as illustrated in FIG. 3, loop members 42 are coupled to the convex faces/locations of various web members 24, thereby extending between and coupling together adjacently located shear web assemblies 20 of adjacent assemblies 10. For example, in the illustrated embodiment, a particular loop member 42 is coupled to convex face/locations of web members $\mathbf{24}_1$ and $\mathbf{24}_2$, to convex faces/locations of web members $\mathbf{24}_3$ and $\mathbf{24}_4$ of assembly $\mathbf{10}_3$, and to convex faces/locations of web members $\mathbf{24}_5$ and $\mathbf{24}_6$ of assembly $\mathbf{10}_1$. Thus, in the illustrated embodiment, this arrangement of a particular loop member 42 with associated web members 22 and 24 form smaller circular arrangements of structural elements (e.g., with web member $\mathbf{22}_1$, web member $\mathbf{22}_2$ of assembly $\mathbf{10}_3$ and web member $\mathbf{22}_3$ of assembly $\mathbf{10}_1$ forming an outer loop, loop member 42 forming an inner loop, and web members $\mathbf{24}_1$-$\mathbf{24}_6$ forming a web assembly between the outer and inner loops). These additional smaller loop arrangements (e.g., smaller than assemblies 10) may be located at various locations about assembly 40. Loop members 42 may be circular (i.e., having a constant radius of curvature) or slightly non-circular.

Figure 4:
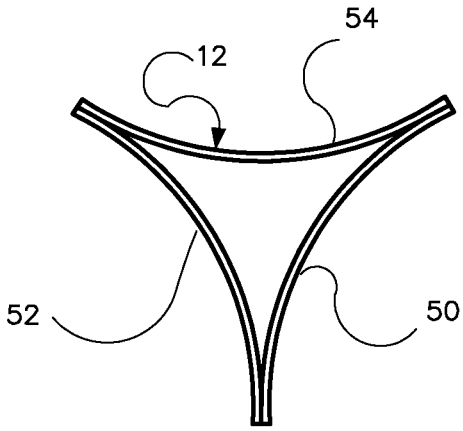
FIG. 4 is a diagram illustrating an embodiment of a member of the load bearing structural assembly illustrated in FIGS. 1, 2 and 3 according to the present disclosure.

In FIGS. 1-3, outer loop members 12, inner loop members 14, web members 22 and 24, and loop members 42 are each depicted as being formed and/or constructed as single/unitary structures or elements. However, it should be understood that each of outer loop member 12, inner loop member 14, web members 22 and 24 and/or loop members 42 may be formed from multiple components/elements and/or having various cross-sectional geometries. For example, FIG. 4 is a diagram illustrating an embodiment of outer loop member 12 in accordance with the present disclosure. In the embodiment illustrated in FIG. 4, outer loop member 12 is formed from three arcuately formed elements 50, 52 and 54 coupled together to form a triangular-shaped cross section for outer loop member 12. Elements 50, 52 and 54 may be configured with any desired radius. It should be understood that a similar triangular-type cross section may be used to form inner loop members 14, web members 22 and 24 and/or loop members 42. It should also be understood that other cross-section arrangements/elements may be used to form outer loop member 12, inner loop member 14, web members 22 and 24 and/or loop members 42 (e.g., ninety degree angle element(s), I-shaped element(s), T-shaped element(s), circular and/or oval element(s), etc.). Outer loop member 12, inner loop member 14, web members 22 and 24 and/or loop members 42 may be formed from any desired structural material with a desired level of flexure to thereby enable bending with some desired level of rigidity (e.g., steel elements/plates, fiber reinforced polymer elements, cured/aged bamboo, and/or other types of materials).

Figure 5:
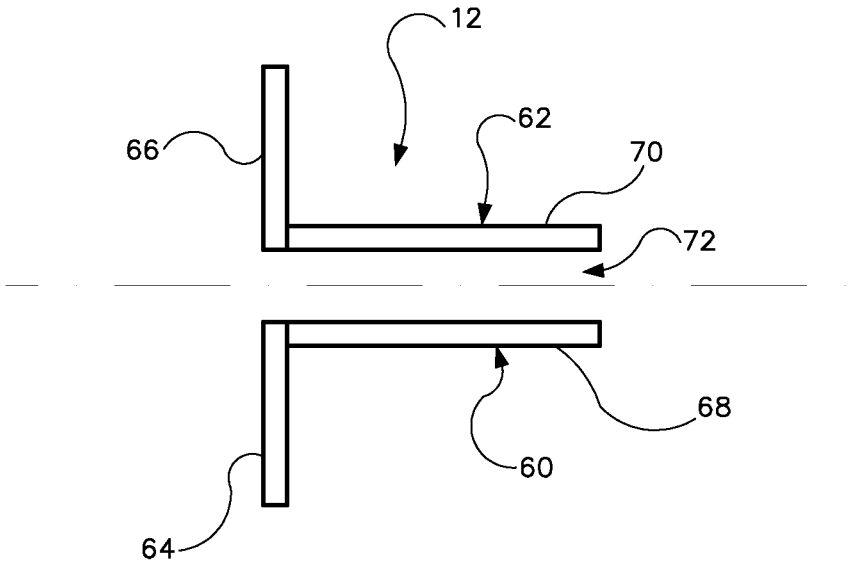
FIG. 5 is a diagram illustrating a section view of another embodiment of a member of the load bearing structural assembly of FIGS. 1, 2 and 3 according to the present disclosure.

Outer loop member 12, inner loop member 14, web members 22 and 24 and/or loop members 42 may also be formed to enable/facilitate attachment to each other and/or therebetween. For example, FIG. 5 is a diagram illustrating a cross sectional view of a T-shaped embodiment of outer loop member 12 according to the present disclosure. In the illustrated embodiment, outer loop member 12 is formed from two ninety degree-shaped elements 60 and 62 such that elements 60 and 62 each have an outward flange 64 and 66, and an inward flange 68 and 70, respectively. In this embodiment, a gap or space 72 is formed between opposing faces of flanges 68 and 70, thereby enabling an element of web members 22 and/or 24, for example, to be located and/or positioned therein to facilitate attachment of web member 22 and/or 24 to loop member 12. It should be understood that the various elements/components of assemblies 10 and 40 may be otherwise configured to facilitate attachment to each other.

Thus, in operation, the load bearing structural assembly of the present disclosure comprises a force resisting system that more efficiently and evenly distributes forces, thereby enabling more efficient use of materials and resisting of forces, as well as a greater limit of deflection. For example, embodiments of the present disclosure provide a load bearing structural assembly that is analogous to a spring laid on its sides, but in a vertical plane, used to store and release energy with movement. The load bearing structural assembly of the present disclosure provides resistance to movement in the elastic range of the material. The load bearing structural assembly according to the present disclosure stores energy more evenly in the assembly while enabling movement to occur through bending, in the elastic range, without yielding, and without exceeding the limits of eccentricity. The load bearing structural assembly according to the present disclosure also includes a number of members that provide redundancy in design. The increased strength of the load bearing structural assembly according to the present disclosure is derived from a repetitive loop configuration and the efficiency generated through the mechanics of the loop which enables controlled movement. The loop design of the present disclosure offers efficiency in material use while optimizing tension/compression/bending forces through the loops.

For example, in some embodiments, loop members 12 and 14, web members 22 and 24, and/or loop members 42 are configured to enable bending with a prescribed level of rigidity. As an example, loop members 12 and 14, web members 22 and 24 and/or loop members 42 may be configured as depicted in FIG. 4 having a triangular configuration, thereby a desired level of rigidity. Loop members 12, 14 and 42 and web members 22 and 24 can be sized and numbered/distributed according to several factors for the particular application, such as the load 18 applied to the load bearing structural assembly, the load 16 applied and to be distributed through the load bearing structural assembly, the limits in member (e.g., loop members 12, 14 and 42 and web members 22 and 24) and assembly 10/40 deflection. The load bearing structural assembly of the present disclosure is configured to deflect in bending with a greater allowed eccentricity due to the circular nature of loop members 12, 14 and 42 and web members 22 and 24 while avoiding significant loss of strength (e.g., such as experienced in the limited eccentricity allowed by post and beam designs). The strength of the load bearing structural assembly of the present disclosure is achieved from the greater allowable bending due to the external loads 16 and 18, and achieved through the circular nature of loop members 12, 14 and 42 and web members 22 and 24, which enables greater load eccentricity. The size and/or configuration of loop members 12, 14 and 42 and web members 22 and 24 may be selected based on the maximum load which must be carried by any one section. In other words, the load bearing structural assembly is designed in view of the strength required to resist the forces to be encountered, and other loading specific to the certain application.

Outer loop 12 is configured to hold the partial assembly (e.g., loop member 14 and shear web 20) in tension and have the required resistance in shear. The cross section area and thickness of loop member 12 (e.g., if a "T" cross section, the cross section of the upper flange and the cross section of the vertical flange) can be adjusted along the length to maximize the use of the material or maintained at a constant value to maximize the speed of construction. The modulus of elasticity, moment of inertia, cross section area, and yielding strength of loop member 12 can be selected/configured according to required loading, deflection, etc.

Web members 24 are configured to transmit shear, resist bending, and transfer forces more evenly between outer loop member 12 and inner loop member 14. For example, web member 24 configured having a "T" cross section may include a tension element (the upper flange of the "T") and a shear element (the vertical flange of the "T"). The section properties of any particular flange, cross section area of the overall member 24 and/or thickness can be adjusted along the length of web member 24 to maximize the use of the material or maintained at a constant value to maximize the speed of construction as required for the performance of the load bearing structural assembly 10/40. The properties of web member 24 may be configured/selected according to required loading, deflection, etc. The shape of web member 24 in section could be represented by back to back "L"-shaped elements separated by a space for connection purposes or be otherwise configured.

Web members 22 are configured to transmit shear, resist bending, and transfer forces more evenly between the outer loop member 12 and inner loop member 14 as well as link the components together (e.g., outer loop member 12, inner loop member 14, web member 24 and/or loop members 42) to form a larger force resisting assemblage (e.g., as illustrated in FIG. 3). Web member 22 may be configured having a "T" cross section with a tension element upper flange and a shear element vertical flange. The section properties of the upper and vertical flanges of web member 22, the overall cross section area of web member 22, and/or thickness can be adjusted along the length of web member 22 to maximize the use of the material or maintained at a constant value to maximize the speed of construction as required for the performance of load bearing structural assembly 10/40. Web members 22 may be configured by back-to-back "L"-shaped elements with a space therebetween for connection purposes or may be otherwise configured.

Inner loop member 14 is configured to resist primarily shear and compression forces due to the bending of outer loop member 12. For example, inner loop member 14 may also be configured having a "T" cross section with an upper flange and a vertical flange where the compressive forces are resisted in shear primarily by the vertical flange of the "T." The upper flange of the "T" controls bending to a lesser extent, and the vertical flange of the "T" to control shear. The section properties of the upper and vertical flanges, the overall cross section of loop member 14 and/or thickness may be adjusted along the length of loop member 14 to maximize the use of the material or maintained at a constant value to maximize the speed of construction as required for the performance of load bearing structural assembly 10/40 and to accommodate required loading, deflection, etc.

Outer loop members 12, inner loop members 14, loop members 42 and web members 22 and 24 are configured and/or designed to be able to bend with some rigidity while not being overly stiff and not exceeding the greater allowed eccentristic loading of the particular members. The assemblage of members 12, 14, 22, 24 and 42 is configured to enable and limit deflection in a truss type arrangement of bending members. The load bearing structural assembly of the present disclosure enables in-plane movement and has a much greater allowable eccentricity of loading due to the loop nature of the assembly. The diameter/radius of the respective members 12, 14, 22, 24 and 42 can vary according to space and strength requirements. The load bearing structural assembly of the present disclosure provides greater strength resulting from the bending of the members 12 and 14 while being braced against over bending by the shear web assembly 20 and allows a great eccentricity of loading. The modulus of elasticity, moment of inertia, cross section area, and yielding strength of members 12, 14, 22, 24 and 42 can be selected to develop a desired deflection, which can be much more than an axially loaded column can absorb, and still stay in the elastic range. The loop configuration of members 12, 14, 22, 24 and 42 enables a much greater deflection to be taken before failure and enables an even distribution of forces among members 12, 14, 22, 24 and 42.

Figure 6:
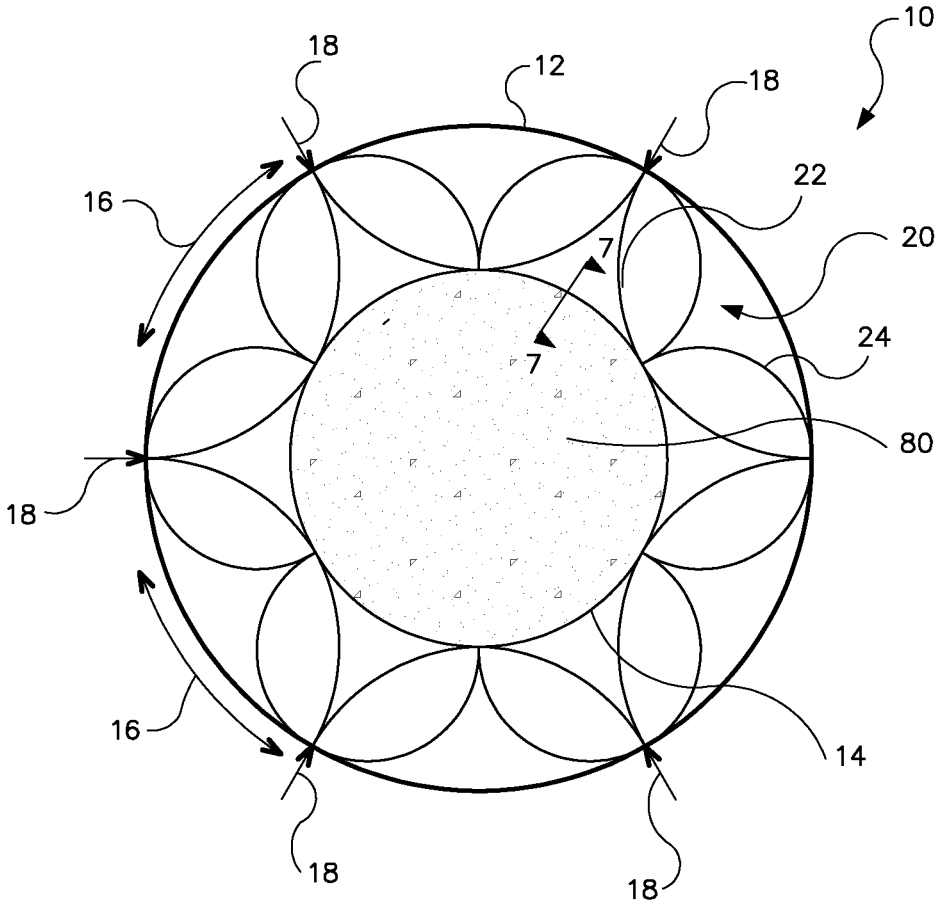
FIG. 6 is a diagram illustrating an embodiment of the load bearing structural assembly of FIGS. 1, 2 and 3 connected to a base according to the present disclosure.
Figure 7:
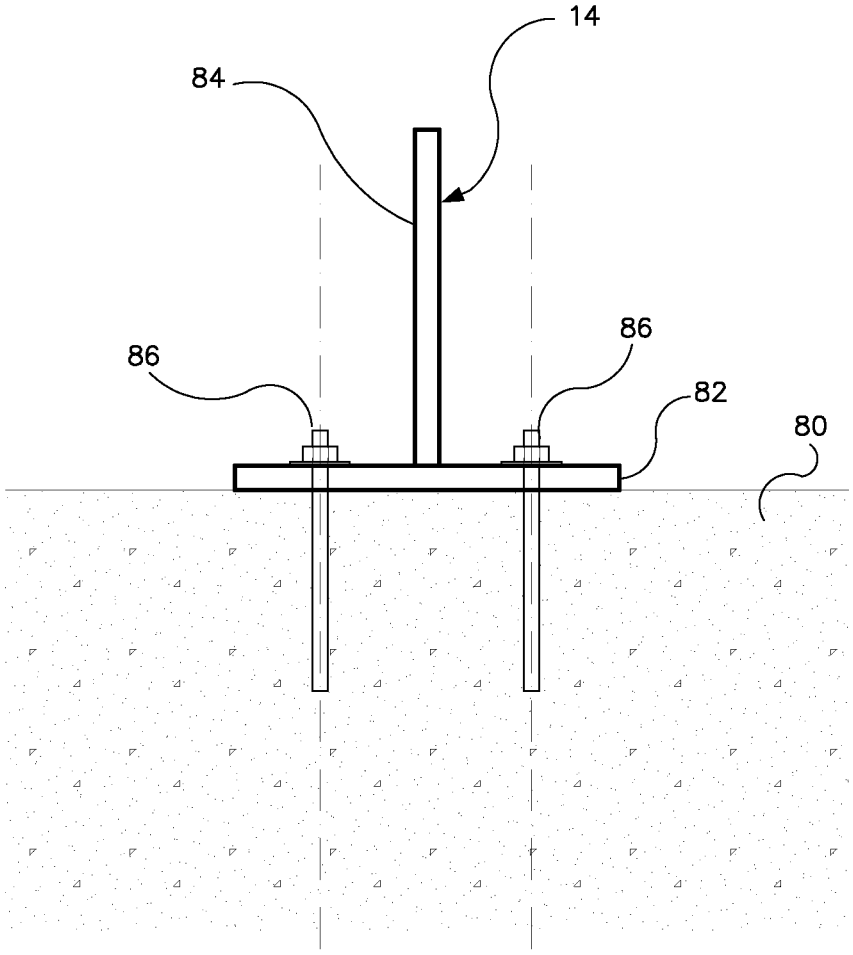
FIG. 7 is a diagram illustrating a section view of a member of the load bearing structural assembly of FIGS. 1, 2 and 3 connected to a base taken along the line 7-7 of FIG. 6 according to the present disclosure.

FIG. 6 is a diagram illustrating an embodiment of assembly 10 connected to a base 80. In some embodiments, to realize the energy input into and through assembly 10/40, a form of base 80 where the final energy can be stored and/or resolved is utilized. Base 80 may comprise a variety of forms (e.g., building foundation, gearing holding, or other structures) which have a mass to absorb and distribute loading and will generally be of greater mass than the members 12, 14, 22, 24 and 42. Base 80 may comprise an integral part of assembly 10/40 and the connection thereto (e.g., to inner loop member 14) can be similar to the shear connection and spaced at desired intervals along the inner loop member 14. For example, FIG. 7 is a diagram illustrating a section view of an embodiment of a connection of inner loop member 14 to base 80 taken along the line 7-7 of FIG. 6 according to the present disclosure. In FIG. 7, inner loop member 14 is configured having a "T" cross section with an upper flange 82 and a vertical flange 84. Upper flange 82 may be secured to base 80 using fasteners 86. However, it should be understood that other configurations/shapes of inner loop member 14 may be used, and other methods of securing/coupling inner loop member 14 to base 80 may be used (e.g., welding, clamps, etc.).

Figure 8:
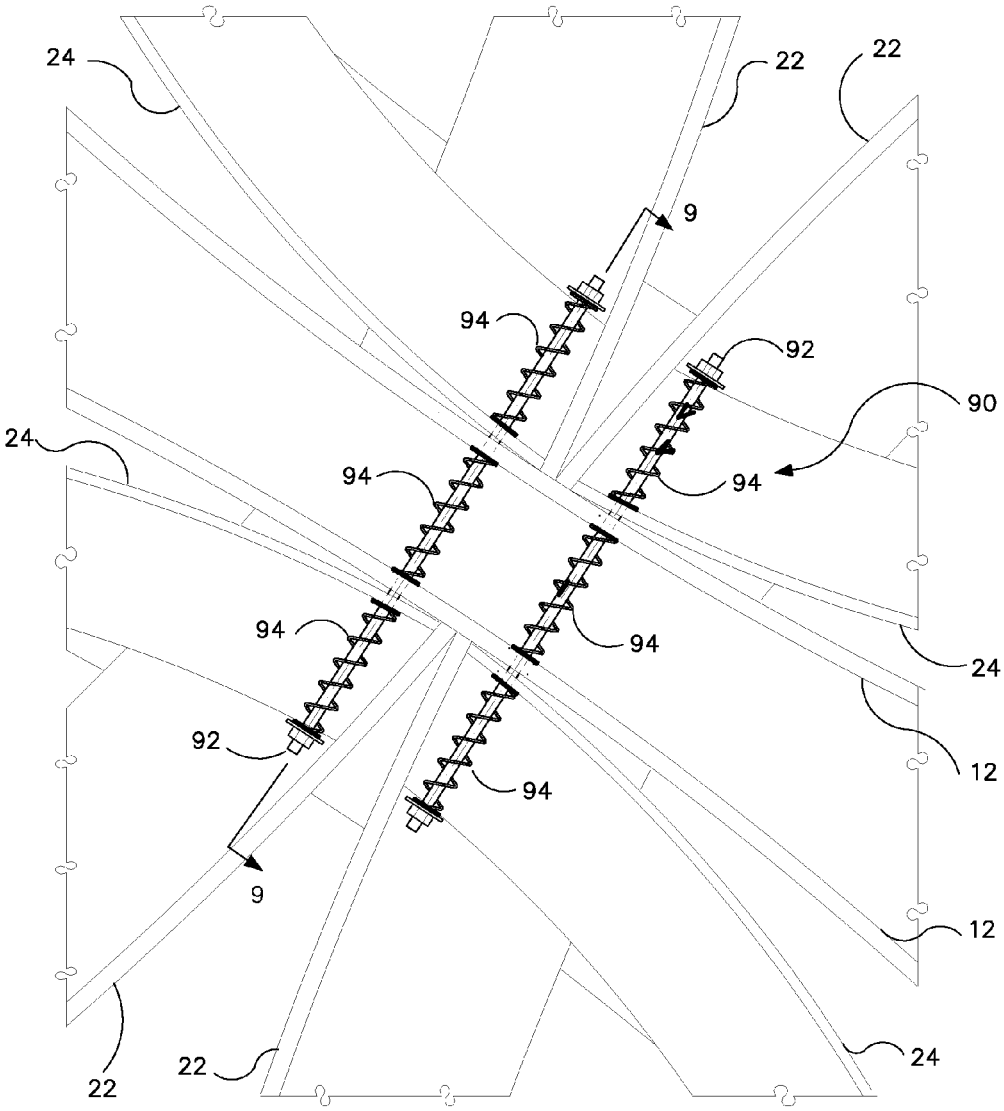
FIG. 8 is a diagram illustrating an embodiment of a coupling system for the load bearing structural assembly of FIGS. 1, 2 and 3 according to the present disclosure.
Figure 9:
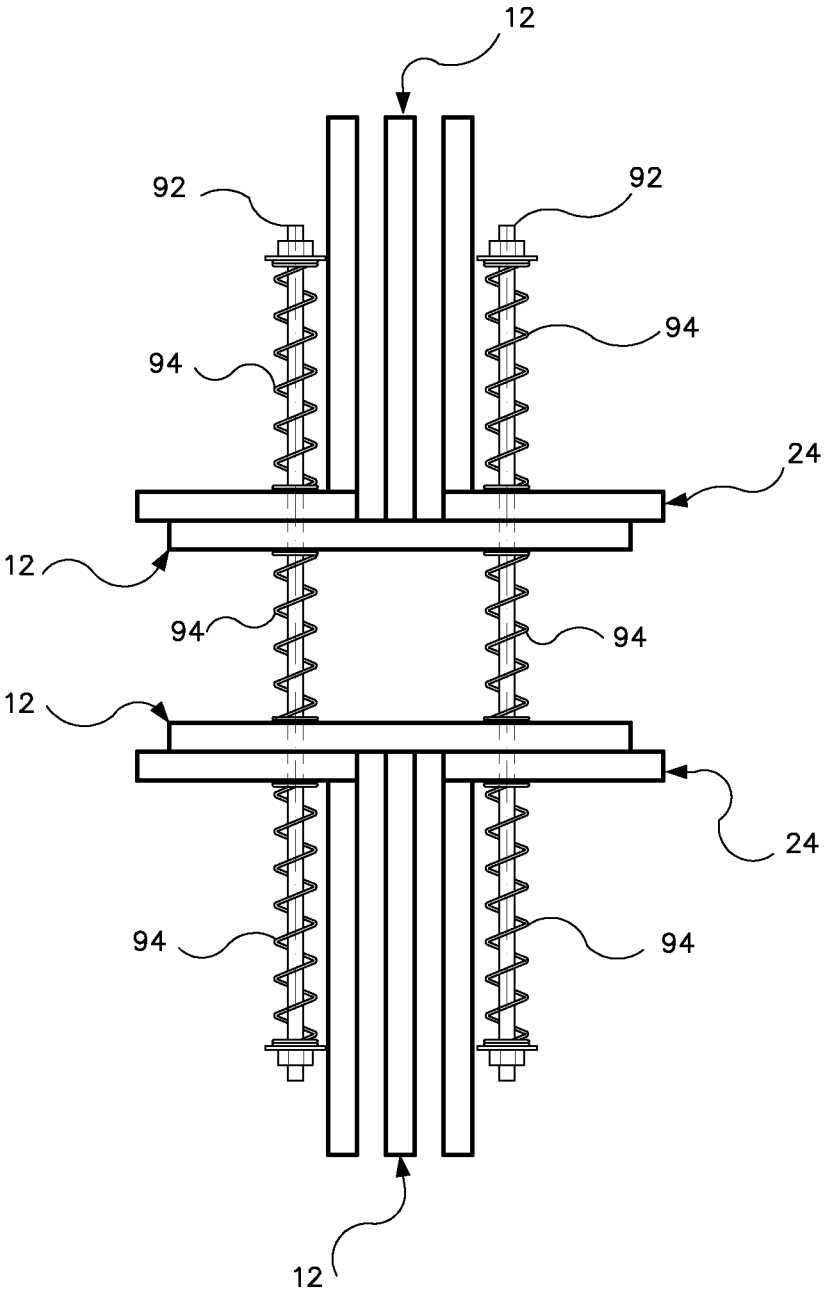
FIG. 9 is a diagram illustrating a section view of the coupling system of FIG. 8 taken along the line 9-9 of FIG. 8 according to the present disclosure.

FIG. 8 is a diagram illustrating an embodiment of a coupling system 90 for assembly 10/40 (FIG. 1) according to the present disclosure, and FIG. 9 is a diagram illustrating a section view taken along the line 9-9 of FIG. 8. In the illustrated embodiment, coupling system 90 is provided to absorb and release energy input into assembly 10/40. For example, in the event a greater allowable deflection is needed from assembly 10/40 due to loading conditions, a greater eccentricity can be provided. System 90 can be used for dissipation of energy through added deflection. In the illustrated embodiment, system 90 comprises a spring-based attachment element including a coupling element 92 in combination with springs 94 (e.g., between opposing loop members 12 and on opposite sides of web members 24). System 90 may be an assortment of materials and shapes used to store and release kinetic and potential energy into and from assembly 10/40. The equilateral triangular alignment of these axial attachments (e.g., attachment of adjoining loop members 12) and the side bearing loads 96 (FIG. 3) between adjoining loop members 12 enables minimal bending while generating the maximum axial elongation of system 90. This elongation can be managed by the stiffness and the length of system 90. The needed rigidity of system 90 will be dependent on the loading of assembly 10/40, the length of system 90, and the allowable deflection generated through the greater eccentricity of the loading.

Figure 10:
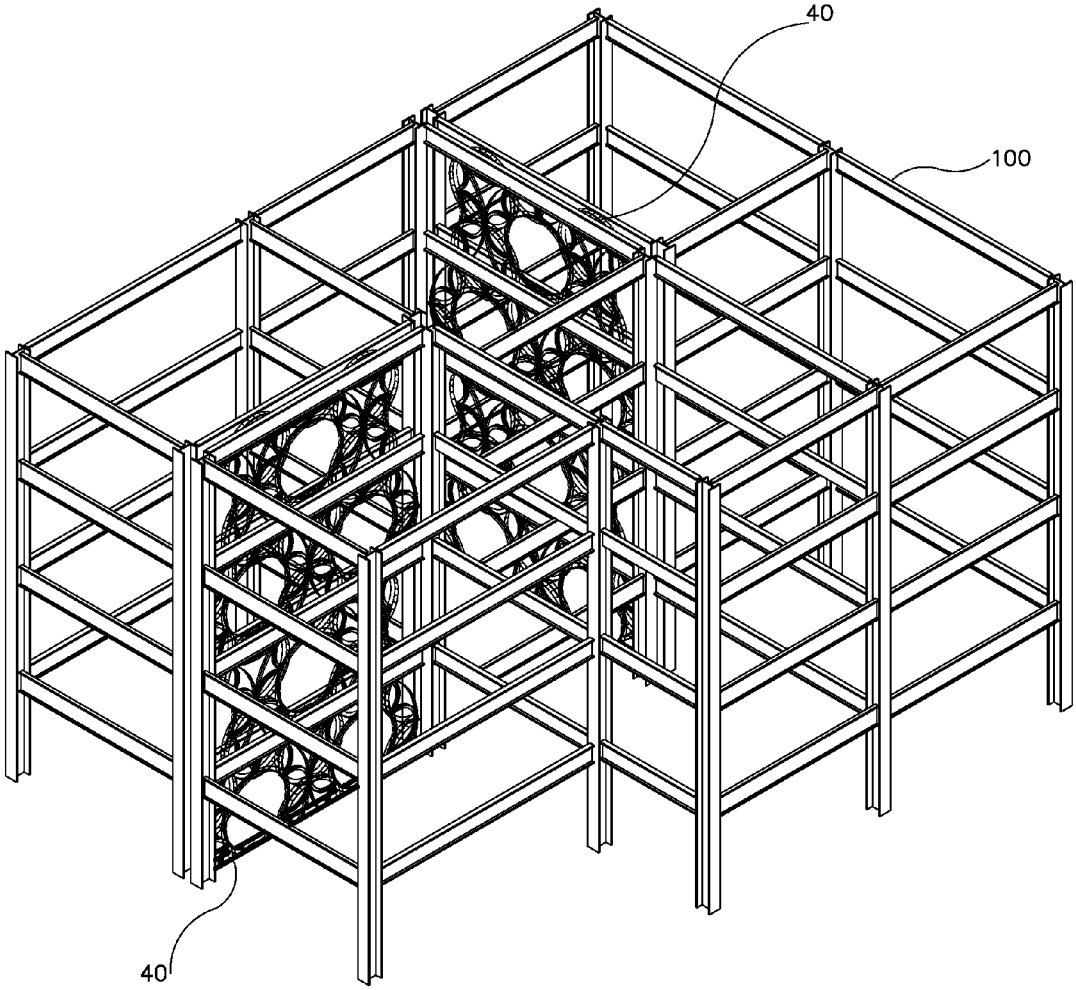
FIG. 10 is a diagram illustrating an isometric view of a load bearing structural assembly according to the present disclosure incorporated into a building frame system.
Figure 11:
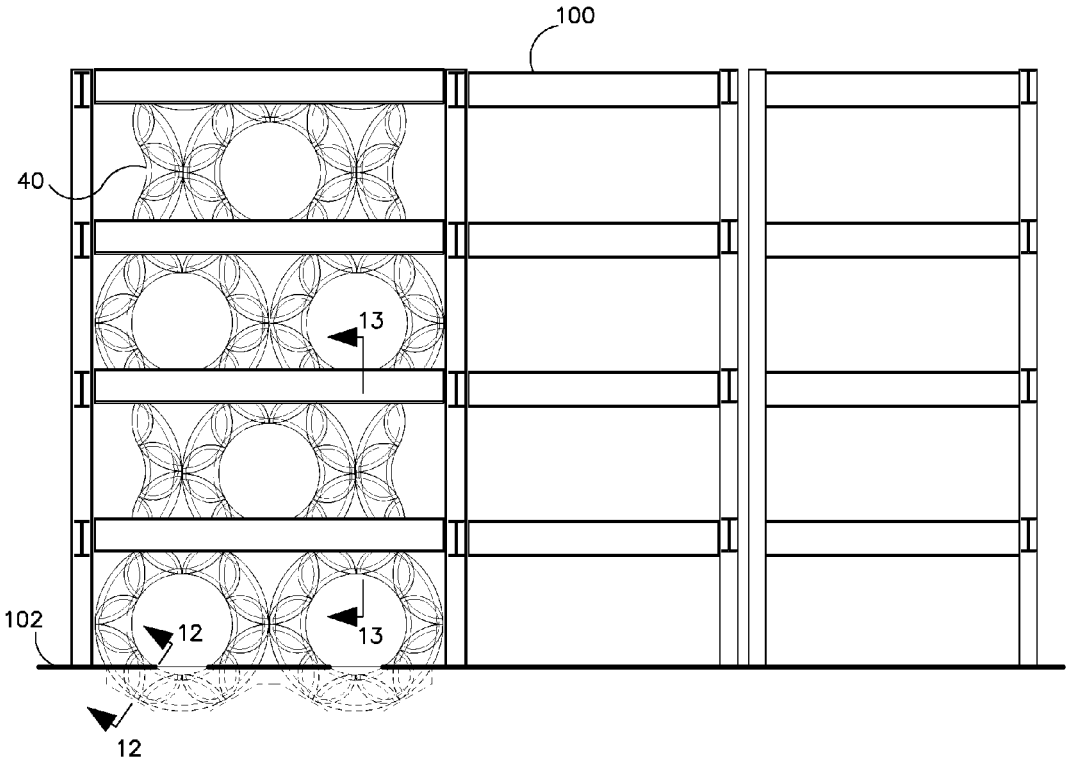
FIG. 11 is a diagram illustrating a plan view of a portion of the frame system and the load bearing structural assembly of FIG. 10 according to the present disclosure.
Figure 12:
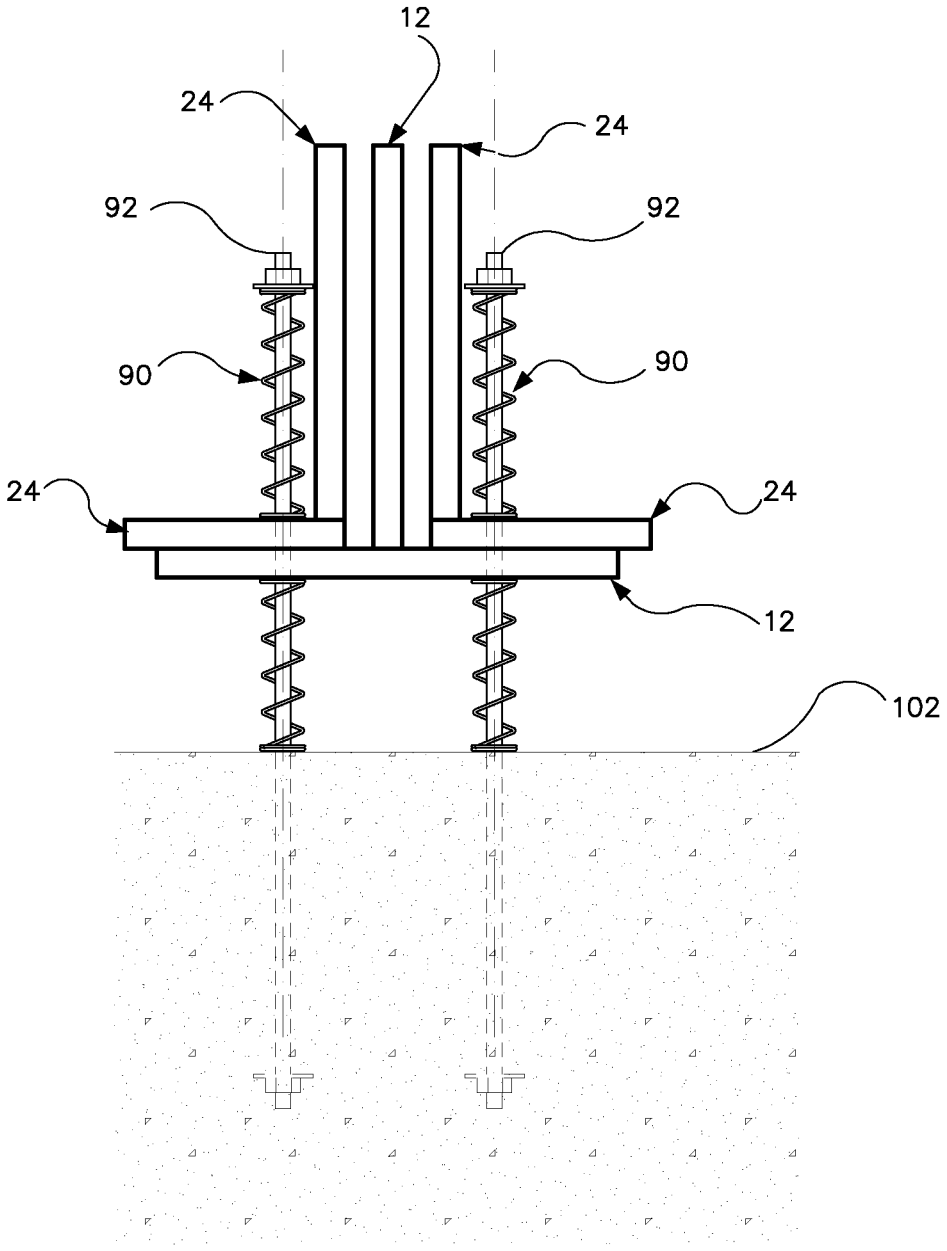
FIG. 12 is a diagram illustrating a section view of an embodiment of a coupling of the load bearing structural assembly of FIGS. 10 and 11 to a base taken along the line 12-12 of FIG. 11 according to the present disclosure.
Figure 13:
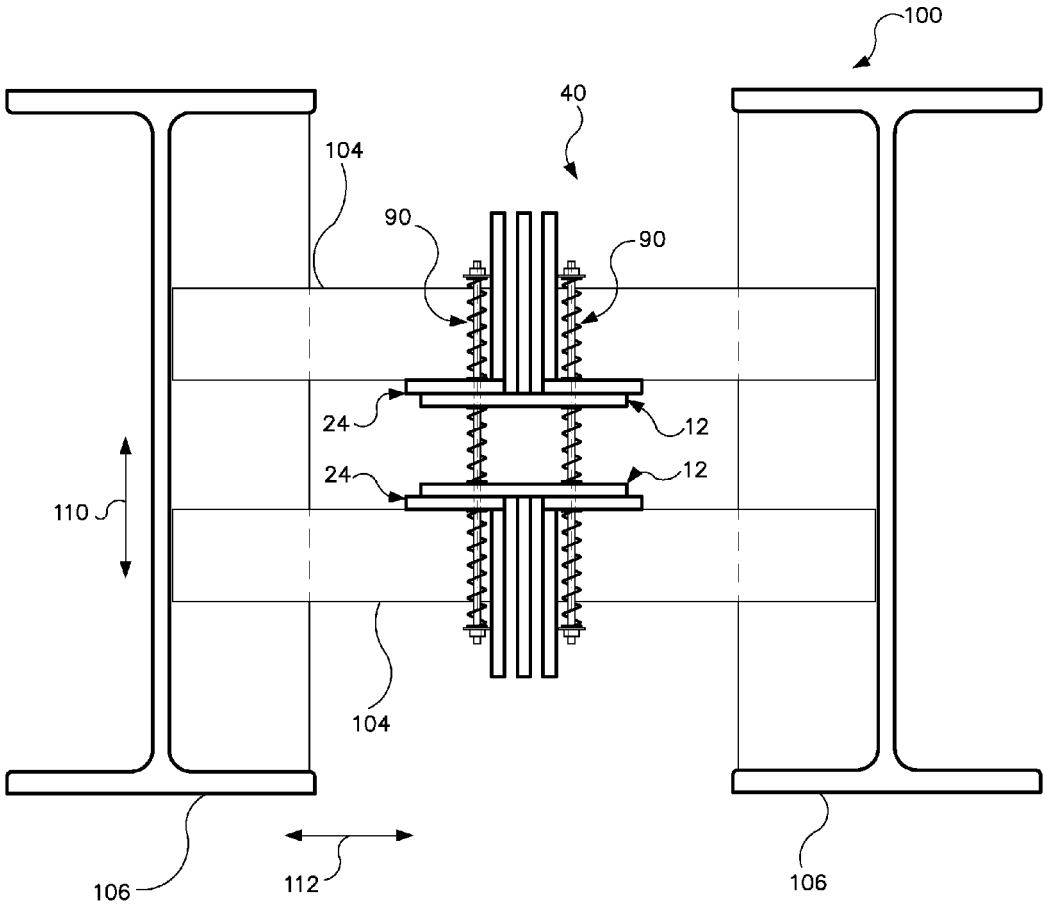
FIG. 13 is a diagram illustrating a section view of an embodiment of the load bearing structural assembly of FIGS. 10 and 11 braced against a frame system taken along the line 13-13 of FIG. 11 according to the present disclosure.

FIG. 10 is a diagram illustrating an isometric view of load bearing structural assembly 40 placed into a building frame system 100 according to the present disclosure, and FIG. 11 is a diagram illustrating a view of a portion of frame system 100 of FIG. 10. In the illustrated embodiment, assembly 40 is integrated into system 100 by bracing assembly 40 against frame system 100 and a base 102. Base 102 is used to store and resolve the energy input into and released from assembly 40. In the illustrated embodiment, energy is stored and released by assembly 40 into base 102 via system 90. For example, FIG. 12 is a diagram illustrating a section view of an embodiment of a coupling of assembly 40 to base 102 taken along the line 12-12 of FIG. 11 using system 90 according to the present disclosure. In this embodiment, assembly 40 releases energy into the base 102 through coupling members 92 anchored in base member 102. The energy input into assembly 40 is also released in the movement of assembly 40 within and against itself. FIG. 13 is a diagram illustrating a section view of an embodiment of assembly 40 braced against frame system 100 taken along the line 13-13 of FIG. 11 according to the present disclosure. In FIG. 13, assembly 40 is coupled to frame system 34 via support members 104 extending between and coupled to adjacent support members 106 of frame system 100. Thus, in operation, assembly 40 is coupled to frame system 100 without fixity and is allowed to move in the direction indicated by 110 within the direction of frame system 100 strength indicated by arrow 112.

Embodiments of the assembly 10/40 of the present disclosure may be used in a variety of applications including, but not limited to, seismic resistance of forces in buildings, systematic release of forces in gears of machines, etc. As an example, assembly 10 may be configured in a wide array of sizes and incorporated into a building frame system (post and beam) to serve the strengths noted above. The size can vary depending on the size/space limitations and forces being handled (e.g., sized into a half story of a building to extending across multiple stories in a building frame system). In addition, assembly 10 may serve as a gear in an overall system with release and channeling of forces along inner loop member 14 and outer loop member 12. As described above, assembly 10/40 can store and release energy in the elastic range and provides predictable movement in this energy transfer between respective gears. While portions of this disclosure of assembly 10/40 are depicted and described for clarity and convenience in two dimensions, assemblies 10/40 according to the present disclosure may be configured in three dimensions to accommodate desired applications (e.g., as depicted in FIG. 2).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

What is claimed is:

1. A load bearing structural assembly, comprising:

a first loop member;

a second loop member spaced apart from and concentric with the first loop member;

a first set of arcuate members extending between the first and second loop members, each of the first set of arcuate members having ends thereof coupled to the first loop member; and a second set of arcuate members extending between the first and second loop members, each of the second set of arcuate members having a first end thereof coupled to the first loop member and a second end thereof coupled to the second loop member; and wherein a radius of curvature of each of the first set of arcuate members is greater than a radius of curvature of each of the second set of arcuate members.

2. The assembly of claim 1, further comprising a spring-based coupling system configured to couple the second loop member to a base.

3. The assembly of claim 1, wherein the first loop member comprises a circular first loop member.

4. The assembly of claim 3, wherein the second loop member comprises a circular second loop member.

5. A load bearing structural assembly, comprising:

a plurality of first loop members coupled together;

a plurality second loop members, each of the second loop members sized smaller than and located within a respective first loop member; and a web assembly coupled to and extending between each respective first and second loop members, each web assembly comprising:

a first set of the web members each having a concave face thereof facing a respective first loop member; and a second set of the web members each having a concave face thereof facing a respective second loop member; and wherein a radius of curvature of each of the first set of web members is greater than a radius of curvature of each of the second set of web members.

6. The assembly of claim 5, further comprising a spring-based coupling system configured to couple adjacent first loop members together.

7. The assembly of claim 5, wherein the first set of web members comprises at least one web member having ends thereof coupled to a respective first loop member and a medial location thereof coupled to a respective second loop member.

8. The assembly of claim 5, wherein the first set of web members comprises a first web member having ends thereof coupled to a respective first loop member and a medial location thereof coupled to a respective second loop member; and the second set of web members comprises a second web member having a first end thereof coupled to one end of the first web member, the second web member having a second end thereof coupled to the medial location of the first web member.

9. The assembly of claim 5, further comprising a plurality of third loop members, each third loop member coupled to and extending between adjacent web assemblies.

10. A load bearing structural assembly, comprising:

a first loop member;

a second loop member sized smaller than and located within the first loop member;

a first web assembly extending between the first and second loop members;

a third loop member;

a fourth loop member sized smaller than and located within the third loop member;

a second web assembly extending between the third and fourth loop members; and a coupling system coupling the first loop member to the third loop member, the coupling system comprising:

a coupling element coupling the first loop member to the third loop member;

a first spring disposed on the coupling element and extending between the first and third loop members; and second and third springs disposed on the coupling element, the second and third springs disposed on opposite sides of respective first and third loop members and against respective first and second web assemblies.

11. The assembly of claim 10, wherein the first and third loop members comprise circular first and third loop members.

12. The assembly of claim 11, wherein the second and fourth loop members comprise circular second and fourth loop members.

13. The assembly of claim 10, wherein the first and second web assemblies each comprise a plurality of arcuately formed web members.

14. The assembly of claim 10, wherein the first spring extends across a gap located between the first and third loop members.

* * * * *